United States Patent [19]

Mª Gabilondo

[11] 4,439,942

[45] Apr. 3, 1984

[54] REVOLVER TYPE FIREARMS

[75] Inventor: Jose Mª Gabilondo, Vitoria, Spain

[73] Assignee: DLlama-Gabilondo y Cia, S.A., Vitoria, Spain

[21] Appl. No.: 173,584

[22] Filed: Jul. 30, 1980

[30] Foreign Application Priority Data

Jul. 30, 1979 [ES] Spain ..... 482.947

[51] Int. Cl.³ ..... F41C 17/08; F41C 1/00

[52] U.S. Cl. ..... 42/66

[58] Field of Search ..... 42/65, 66

[56] References Cited

U.S. PATENT DOCUMENTS 829,082 8/1906 Murphy ..... 42/66

3,996,686 12/1976 Baker ..... 42/65

4,001,962 1/1977 Baker ..... 42/65

4,067,131 1/1978 Ruger et al. ..... 42/65

*Primary Examiner*—Charles T. Jordan

*Attorney, Agent, or Firm*—Karl W. Flocks; Sheridan Neimark; A. Fred Starobin

[57] ABSTRACT

A safety mechanism made up of a pawl that connects the hammer and trigger and is mounted eccentrically on the rotation pin of the hammer, moving the hammer upward and downward with a part for fastening the cylinder during firing. A tooth on the trigger contacts a tooth on the hammer and when the trigger is pulled, the hammer rotates on the pawl rotating downward to a point where the trigger and hammer are disconnected throwing the hammer forward. When pressure is let up on the trigger all parts return to their rest position.

1 Claim, 7 Drawing Figures

REVOLVER TYPE FIREARMS

This invention relates to improvements in firearms, of the double-action revolver type, for high-power cartridges and more specifically for high-power revolvers and, of course, for low-power ones.

In standard revolvers a series of problems often arises from their design, of which we will indicate some of the most important ones.

One of the problems arises from the revolver safety mechanism, made up of the suitable combination of a hammer and a safety piece. The hammer has a rotary movement so that, during firing, it acts on the firing pin, the revolver frame exhibiting a slot in which the end of a safety piece is housed, so that, the weapon being in the safety position, the hammer is interrupted by the obstacle of said piece in said slot, without the possibility of striking of the firing pin.

However, this system requires a great number of auxiliary parts, even if not effective in very many cases because of breaking of said part, which causes firing even with the safety on.

On the other hand, fastening of the revolving cylinder unit normally causes problems due to the fact that, when the projectile is launched, recoil and lateral reaction forces are released which often produce a lack of alignment between the chamber and barrel. The cylinder was located with two fittings, along its longitudinal axis, one on the side of the hammer, and the other in the front zone located approximately in the central portion of the barrel. The distance between both fitting points is considerable and causes sags in the unit and consequently produces a lack of alignment between the cylinder and barrel at the moment of firing.

Also, in standard revolvers, the cylinder arm is drawn by the trigger when a strong force is exerted on it, so that the arm with its single tooth acts on the cylinder to make it turn 60°, later being without a link with the cylinder, which is a shortcoming in the fastening precisely at the moment of firing.

The invention presents the following with the basic purpose of avoiding these drawbacks:

1. A mechanism for blocking the cylinder, which is strong enough to support fully the pressure of high-power and obviously low-power cartridges.

2. A locking mechanism that avoids sags in the cylinder unit which fastens the cylinder at the moment of firing, avoiding possible movements of it in the axial and circular directions.

3. An automatic safety of great effectiveness, since indirectly it makes the hammer spearate from the firing pin and rest only on the frame and not on intermediate parts.

4. An increase in precision, provided by the special geometry of the bore of the barrel.

5. Finally, a revolver of great safety, simpler and with a smaller number of parts than standard ones.

With respect to the features of the safety, which in this case we will call automatic, we will begin by indicating that its mechanism has three basic parts: hammer with its tooth, trigger and pawl. When the trigger is pulled, the hammer moves, which actually is drawn by its tooth, since the pawl is drawn by a pin of the arm, which is placed in the trigger for this purpose. The hammer turns in a rotating movement of the pawl but at the same time it makes this movement it describes another movement downward until a point is reached where the hammer and trigger are disconnected, the hammer being thrown by the force of its spring toward the firing pin, producing the impact of the latter on the cartridge.

At the moment the disconnection of the trigger and hammer occurs, the hammer is in its lowest position, since the pawl is in its highest position. As the hammer rotates on the pawl, on being driven by its spring, said hammer makes the impact on the firing pin only by the rotating movement. When finger pressure on the trigger stops, the trigger returns to its normal position, driven by the force of the spring put there for this purpose. The pawl consequently turns on its pin, drawn by the trigger and makes the hammer describe a rising movement whereby it leaves the firing pin free and rests directly on the wall of the frame in a safety position.

When the hammer rests on the frame, the safety position can be considered as automatic and derived precisely from the joint movement of the three parts. This automatic safety position does not offer any risk of accidents caused by dropping the weapon or for any other reason by totally eliminating the risk of chance blows to the hammer that would make an undesired firing possible. Any chance blow to the hammer is transmitted to the frame and not to the firing pin.

Fastening of the revolving cylinder group, also a basic object of the invention, has been done on the basis of the following strategy:

rotating of the cylinder to the right;
special design of the cylinder arm; and
bolt to lock the revolving unit in the frame close to the barrel.

In accordance with this, there is placed an arm connected to the trigger, an arm which, when a force is exerted on said trigger, is raised so that its tooth comes in contact with one of the teeth of the extractor, making the cylinder revolve to the right in a rotating movement, as is done conventionally. However, the arm exhibits a second tooth, a continuation of the first, the space between the two corresponding approximately to that of each tooth of the extractor, so that, when firing occurs, this second tooth or "locking tooth," firmly holds one of the teeth of the extractor by exerting an upward force, whereby there is obtained an effective holding of the cylinder with its catch and a perfect locking of the revolving unit to the frame. This bolt for locking the revolving unit is located in a zone very close to the entry of the bullet into the barrel, locking of the frame-cylinder-revolving unit being achieved in a much more effective and simple way. This mechanism is made up of an L-shaped part, actuated by the slide button which moves longitudinally so that the end of its horizontal arm acts on a bolt forced by an opposing spring, whose beveled end comes in contact with an inclined recess or wall of a vertical part, whose upper end is housed in a recess of the frame, specifically in a zone very close to the barrel. The entire L-shaped mechanism is housed in a suitable groove of a side cover of the weapon, while the horizontal bolt is introduced in a suitable hole in the frame, below, and the front locking bolt takes on an inclined position until it meets the body of the barrel.

The longitudinal advance of the front locking bolt of the revolving unit and its design provide a better alignment of the revolving unit with the barrel and a considerable reduction in the sag of said revolving unit, while the solidness is increased.

In turn the precision of the weapon is considerably increased thanks to the specific polygonal shape of the bore of the barrel. For this purpose, one of the lateral parts of the bottom of the space between rifling grooves, which are normally parallel or radial in relation to the geometric center of the bore is inclined in sense of shortening said space between the side parts of said space so the angle made by the normal side and modified side according to the invention is 90° to achieve maximum conditions of precision.

A non-limiting representation of the above is shown in the accompanying drawing in which are shown the following:

FIG. 1 is an elevation corresponding to the firing and safety mechanism in firing position;

FIG. 2 relates to the same mechanism in the safety position;

Figure 7:
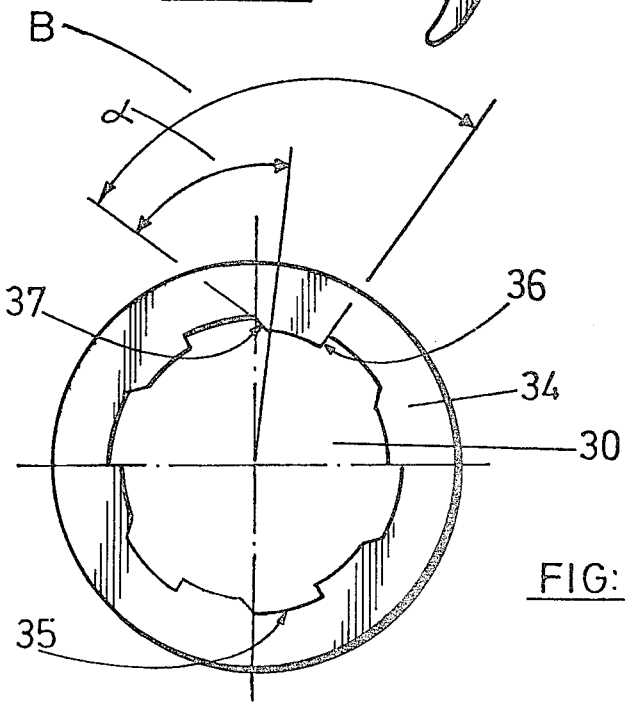

FIG. 7 finally corresponds to the specific cross section of the bore of the barrel.

Figure 1:
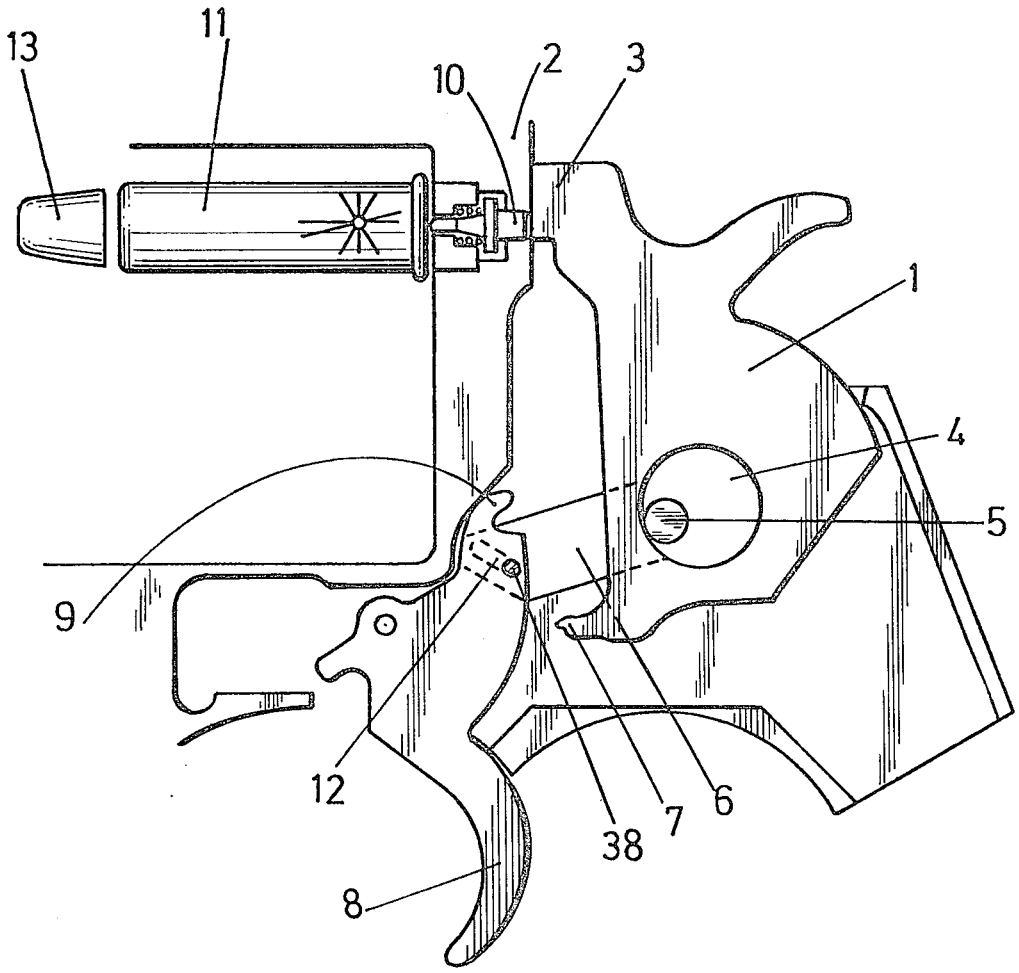
Figure 2:
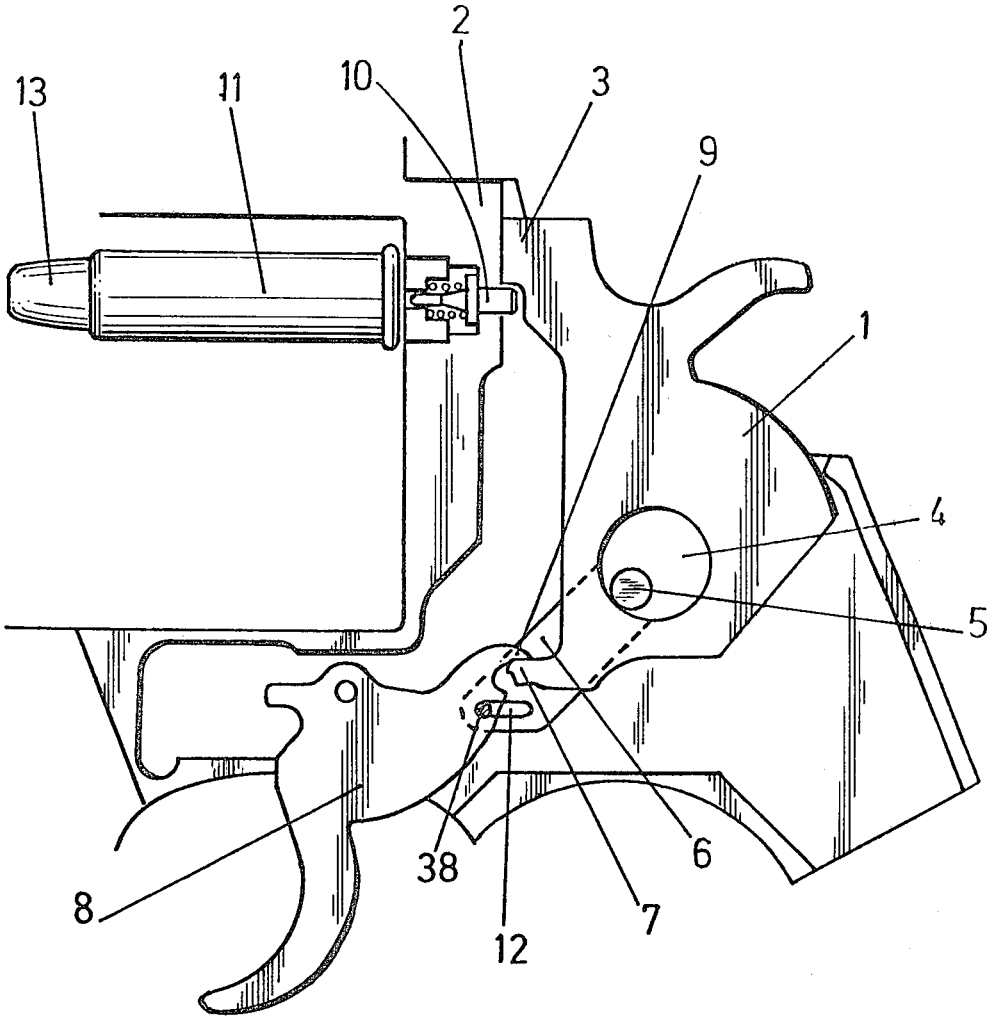

With respect to FIGS. 1 and 2 we will begin by indicating that on frame 2 of the revolver are located trigger 8, hammer 1 and pawl 6. The hammer has a spring that allows it to turn with sufficient force on 4 to cause firing by hitting firing pin 10. In these figures, when trigger 8 is pulled, there go into motion hammer 1 carried by suitable tooth 7 and pawl 6 carried by pin 38 of the face, not shown, of trigger 8, the pin being housed in groove 12 of said pawl 6.

Naturally, the trigger turning with a rotating movement on pawl 6, so that at a suitable time it can make this movement, describes another downward movement until the contact between teeth 9 and 7 is broken. At this moment, the hammer is thrown by the action of its spring toward firing pin 10, causing firing.

Exactly at this moment, i.e., when trigger 8 and hammer 1 are disconnected, the hammer is in its lowest position, because the pawl is in the highest position. Since hammer 1 turns on pawl 6 when thrust by its spring, at that moment, only hammer 1 will make a turn, i.e., only the movement of rotation since the lowering movement was made when there was contact between teeth 9 and 7.

When the pressure of the finger is taken off trigger 8, it returns to its normal position, compelled by its recoil spring and the pawl turns on the trigger pin by movement in groove 12 carried by said trigger 8, so that pawl 6 makes hammer 1 describe a rising movement. This rising movement releases the contact of firing pin 10 and hammer 1 and allows (FIG. 2) the hammer to rest directly on frame 2 by its end 3.

Figure 3:
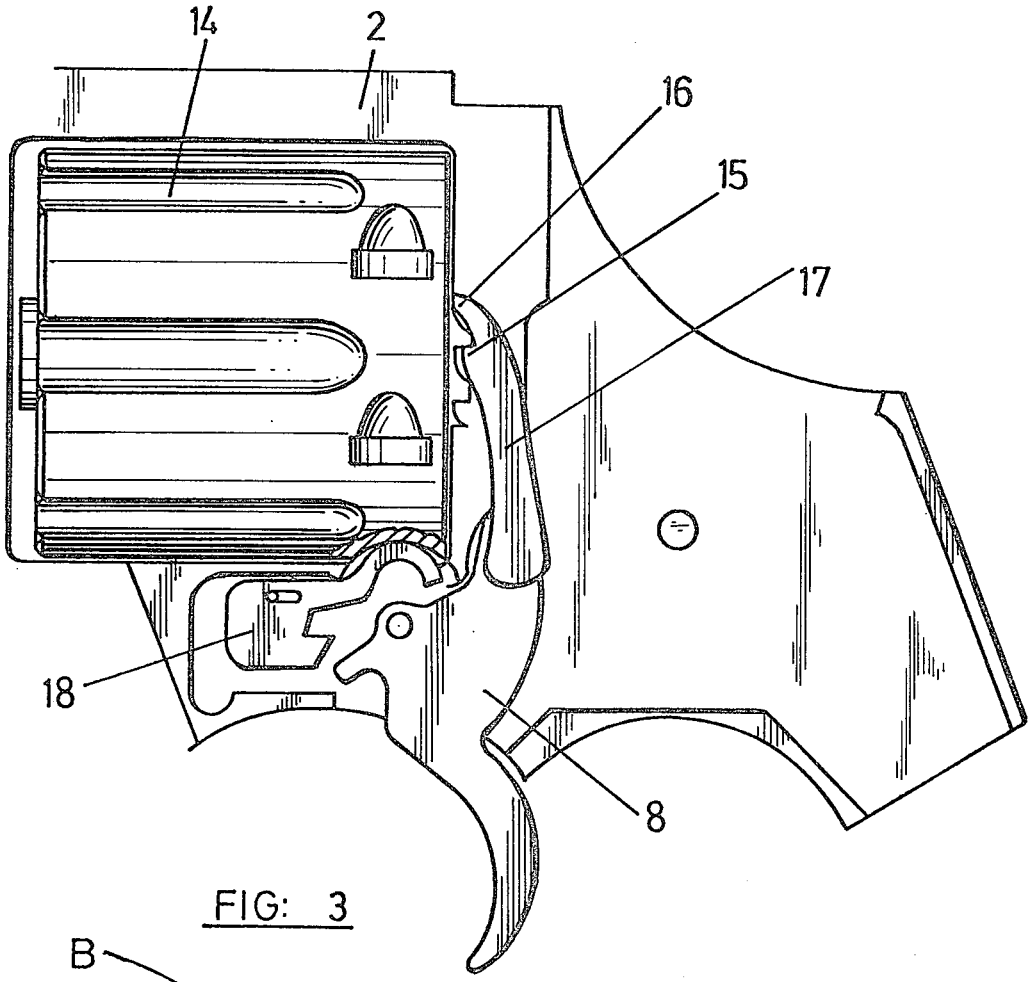
FIG. 3 is a detail in elevation of the mechanism for holding the revolving unit.
Figure 4:
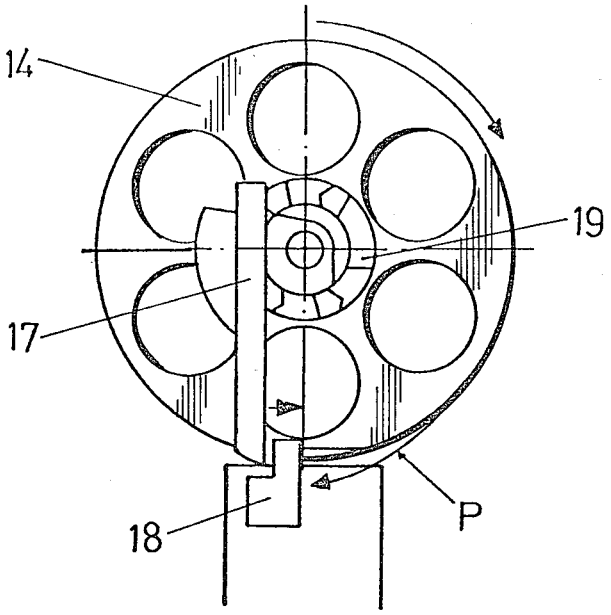
FIG. 4 is a side view of the preceding figure.

According to FIGS. 3 and 4, we see how the actuation of trigger 8 causes the rise of arm 17 whose upper end or tooth 16 comes in contact with teeth 19 of the extractor to make cylinder 14 turn 60° to the right as it is actuated by each firing. Tooth 16 is normally provided in revolvers, a detail that is brought out to show the function, on the other hand, of the second or locking tooth 15 below tooth 16 mentioned above, which precisely at the moment of firing acts firmly on another of teeth 19 of the extractor, exerting a force in the upward direction which is translated into a lateral force P (FIG. 4) which achieves a fastening of cylinder 14 with its catch 18 and the consequent locking of the revolving unit on frame 2.

Figure 6:
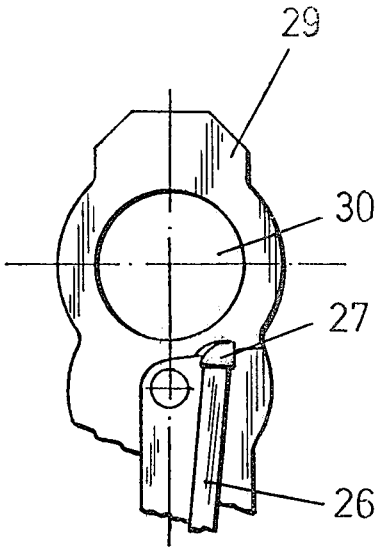
FIG. 6 shows section AA' made in the preceding figure.
Figure 5:
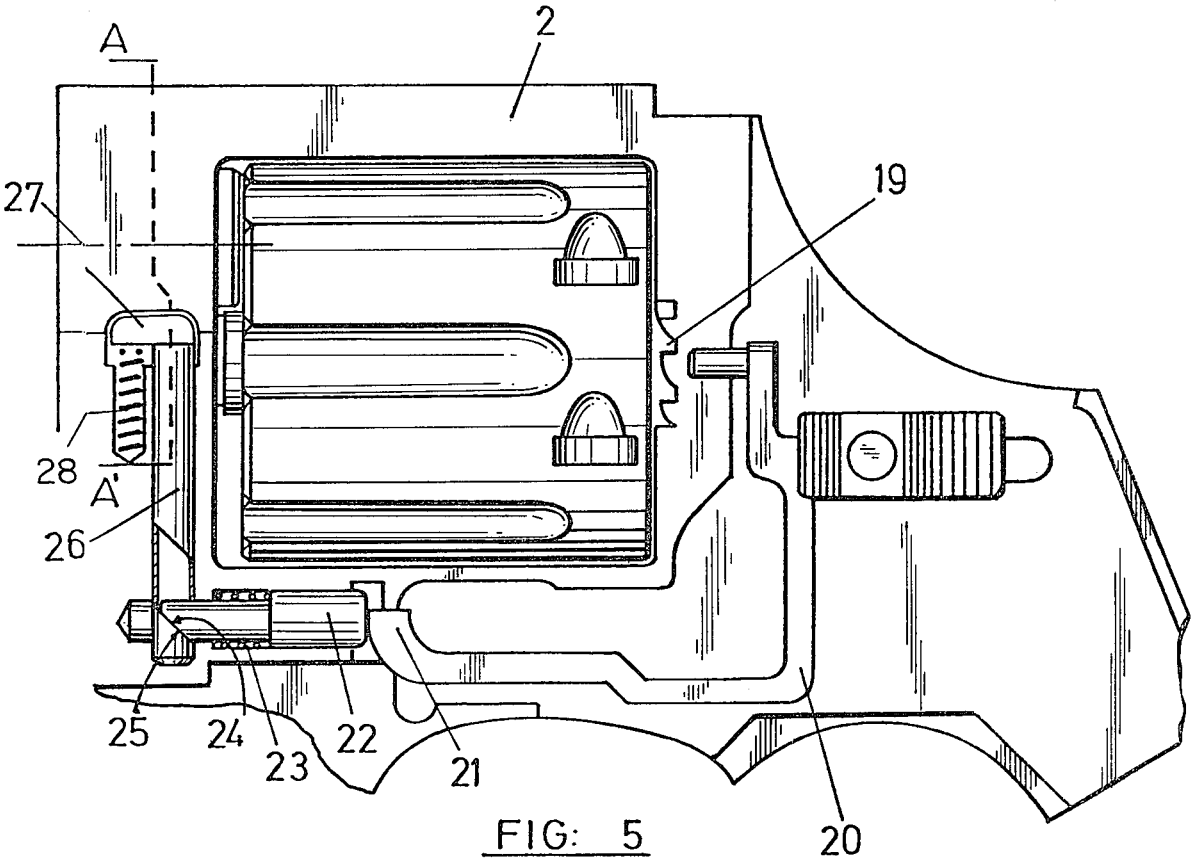
FIG. 5 is an elevation of the front holding system for the revolving unit.

In turn the locking bolt of the revolving unit is made, on the basis of an arrangement that goes from the slide button, through L-shaped piece 20, substantially horizontal, which with its front end 21 comes in contact with horizontal bolt 22, which by its portion 24 slides over surface 25 of bolt 26. Actuation of piece 20 to the left (according to FIG. 5) will lower bolt 26, leaving the contact of the upper end 27 free, at the same time that springs 23 and 28 are overcome. The specific position of point 27 and its location are as close as possible to the entrance of the bullet into the barrel, blocking the unit in the most effective way. Parts 20 and 22 are located in a side cover of the revolver and part 26 naturally with an inclination (FIG. 6) so that its end 27 finds access to a zone of the frame of consistent section, as duly reflected in FIG. 6.

Finally, and with respect to FIG. 7, we will indicate the particular shaping of the interior of the bore of the barrel 30, in which one of the side walls 37 of the rifling grooves is placed with a specific angular feature, in the sense of defining angle $\alpha$ formed by surface 37 and the radial plane that passes through its point closest to the center. Since this angle can vary, as a function of the diameter of the bore of the barrel, this possibility is made specific with the fact of fixing at 90° the corresponding angle between the constitutive planes of the surfaces of planes 36 and 37, with the constant thus defined, and after running of tests, the precision of the revolver in firing at a target is considerably increased.

Once the nature and advantages of this invention have been described, its non-limiting character should be pointed out, therefore changes in shape, material or dimensions of its constitutive parts in no way will alter its essentiality, to the extent that variation in the unit is not made.

I claim:

1. Improvements in revolver type firearms, characterized in that a trigger (8) is connected to the end of a pawl (6) by a projection (38) of said trigger (8) which is housed in an opening (12) of said pawl (6), pawl (6) which in turn is connected eccentrically to a circular part (4) on which a hammer (1) turns so that upper end (3) of said hammer (1) rests directly on a frame (2) when said trigger (8) is in rest position, in which a tooth (9) of said trigger (8) comes in contact with another tooth (7) of said hammer (1), and so that, when said trigger (8) is pulled, said hammer (1) rotates on said pawl (6) and at the same time said hammer (1) describes a downward movement to a point at which said hammer (1) and said trigger (8) are disconnected, said hammer (1) being thrown forward, an end (3) of said hammer (1) occupying the lowest position or fire position against a firing pin (10), and said pawl (6) the nearest position to the horizontal position, while when pressure is let up on said trigger (8) it returns to the rest position and said pawl (6) turns towards a vertical position making said hammer (1) describe an elevation movement resting as at the beginning on said frame (2) of the firearm.

* * * * *